United States Patent [19]

Hagelthorn

[11] 4,117,533

[45] Sep. 26, 1978

[54] MODULAR LIGHTING SYSTEM

[76] Inventor: Allan T. Hagelthorn, 223 E. 78th St., New York, N.Y. 10021

[21] Appl. No.: 770,104

[22] Filed: Feb. 18, 1977

[51] Int. Cl.[2] ..... F21L 7/00

[52] U.S. Cl. ..... 362/367; 362/125; 362/311; 362/363; 362/414; 362/806

[58] Field of Search ..... 240/2 AT, 81, 10 R; 362/125, 311, 363, 367, 414, 806

[56] References Cited

U.S. PATENT DOCUMENTS 3,868,671 2/1975 Maguire ..... 240/10 R

*Primary Examiner*—Stephen J. Lechert, Jr.

*Attorney, Agent, or Firm*—Paul J. Sutton

[57] ABSTRACT

A modular lighting system comprising a module having four panels containing photographs or the like with a source of illumination inside the panels to provide lighting for the panels as well as lighting to the surrounding area. The module may be hung from the ceiling, supported on a lamp base or stacked with other elements similar to the module in concept and design.

10 Claims, 6 Drawing Figures

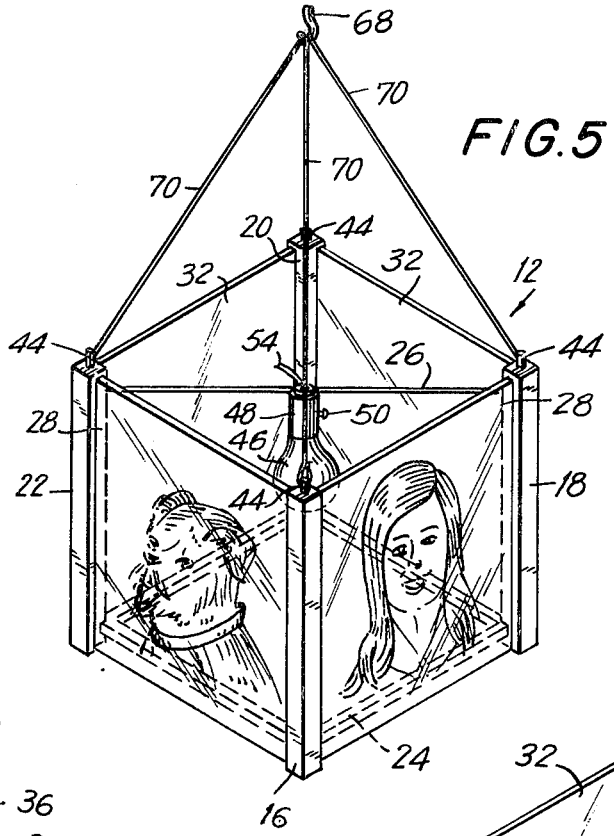
FIG. 5
FIG. 4
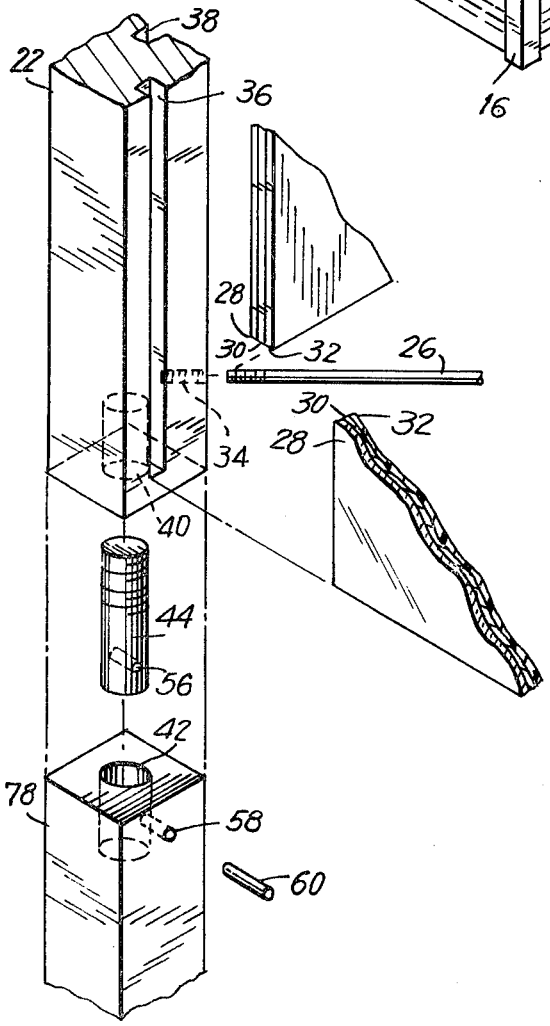
FIG. 6
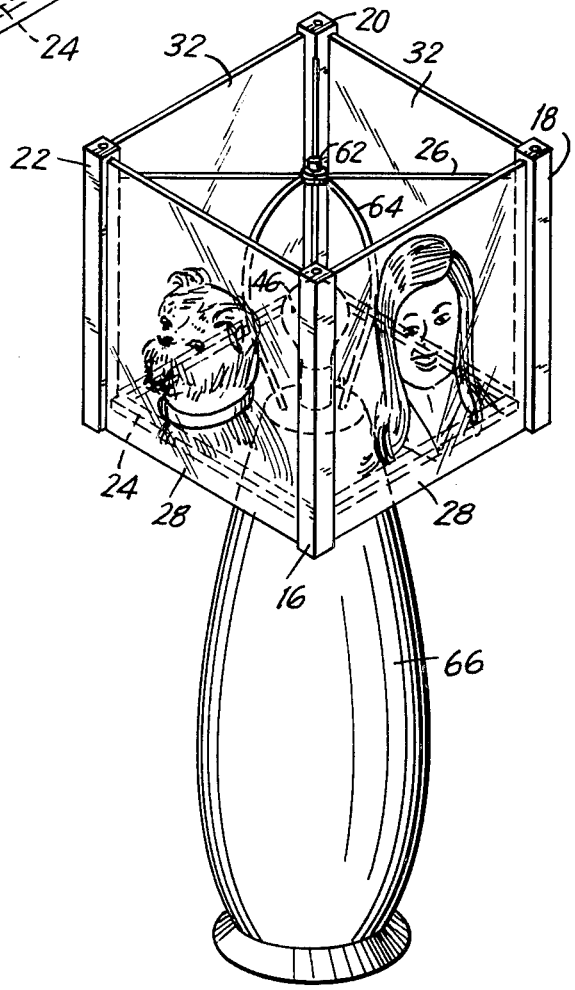

MODULAR LIGHTING SYSTEM

This invention relates generally to lighting systems and the like. In particular, this invention presents an improved modular lighting system wherein photographs and the like may be displayed for education and/or entertainment purposes. Further, the design of the modular lighting system may be changed in a simple manner.

Accordingly, it is an object of the present invention to provide a modular lighting system capable of assuming a plurality of design arrangements.

Another object of this invention is to provide a lighting system which is an educational aid.

Yet another object of this invention is to provide a lighting system which is entertaining, or aesthetically pleasing.

A further object of this invention is to provide a stackable lighting system having building-block capabilities.

Still another object of this invention is to provide a lighting system with knockdown capabilities, which yields improved stocking and shipping advantages.

Still yet another object of this invention is to provide a lighting system adaptable to ceiling, wall, floor or table use.

My invention will be made more clearly understood from the following description of specific embodiments of the invention, together with the accompanying drawings, wherein similar reference characters denote similar elements throughout the several views and in which:

FIG. 4 is an exploded view of a corner post and support post assembly;

FIG. 5 is another lighting subassembly module and method of support; and

FIG. 6 is yet another method of supporting lighting subassembly module.

Figure 1:
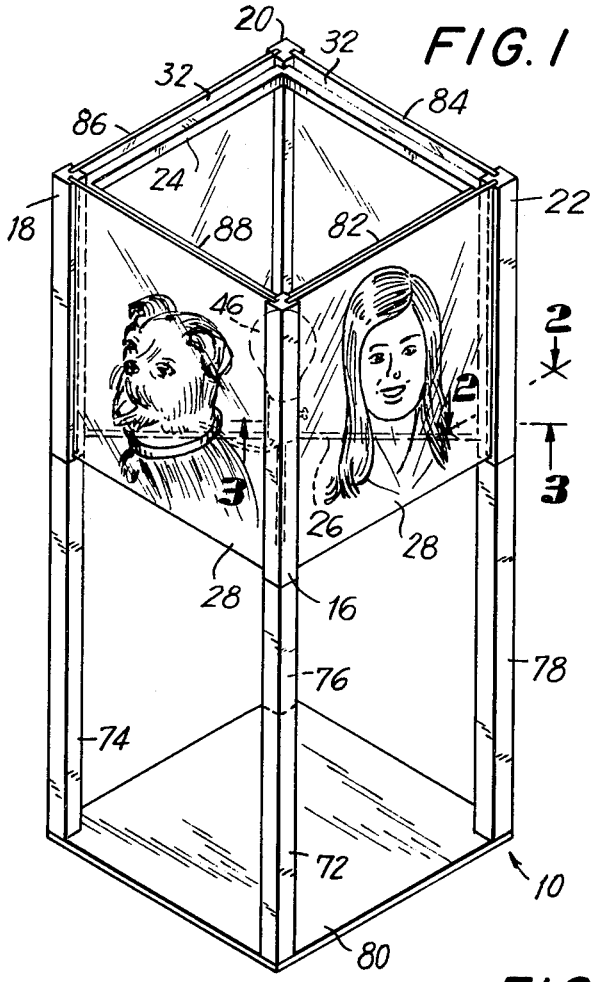
FIG. 1 is a perspective view of a lighting subassembly module and support structure.

Referring to the drawings in more detail, FIG. 1 shows a lighting subassembly module supported on a support base and generally designated 10.

A first corner post 16 includes smooth hole 42 at its topmost end, a matching hole 58 proximate a threaded hole 40 at its bottommost end and a threaded diagonal hole 34 proximate threaded hole 40. First corner post 16 also has a first panel assembly groove 36 and a second panel assembly groove 38 and is typical of all corner posts.

Demountable secured by first panel assembly groove 36 is a first panel assembly 82 formed of an outer panel 28, a center panel 30 which may be a photograph or the like and an inner panel 32 whereby the photograph is supported and maintained in a flat condition by outer panel 28 and inner panel 32.

Directly opposite first panel assembly groove 36, which is part of first corner post 16, is located second panel assembly groove 38 which is part of a fourth corner post 22. Demountable secured by the last foregoing second groove 38 is first panel assembly 82 formed by outer panel 28, center panel 30 and inner panel 32.

In a similar manner, a second panel assembly 84 consisting of outer panel 28, center panel 30 and inner panel 32 is demountably secured by first panel assembly groove 36, which is part of fourth corner post 22, and second panel assembly groove 38 which is part of a third corner post 20.

In an analogous manner to that preceding, a third panel assembly 86 which consists of outer panel 28, center panel 30 and inner panel 32 is demountable secured by first panel assembly groove 36 which is part of third corner post 20 and second panel assembly groove 38 which is part of a second corner post 18.

Similarly, a fourth panel assembly 88 consisting of outer panel 28, center panel 30 and inner panel 32 is demountably secured by first panel assembly groove 36 which is part of second corner post 18 and second panel assembly groove 38 which is part of first corner post 16.

First, second, third and forth corner posts 16, 18, 20 and 22 maintain their relative positions since each post is fastened proximate the topmost end to a separator frame 24 by fastening means.

The bottommost ends of first, second, third and fourth corner posts 16, 18, 20 and 22 are kept in their requisite positions by a support frame 26 threaded into each diagonal hole 34.

Lighting subassembly module is supported by a first, second, third and fourth support post 72, 74, 76 and 78 which are themselves integral with a support base 80, and each having smooth hole 42.

Shown integral with support frame 26 is a bulb 46, a socket 48, a switch 50 and an electric line cord 54. It is contemplated that the support post have a slot therein to receive electric line cord 54. Bulb 46 serves to illuminate the panels from the rear.

Figure 2:
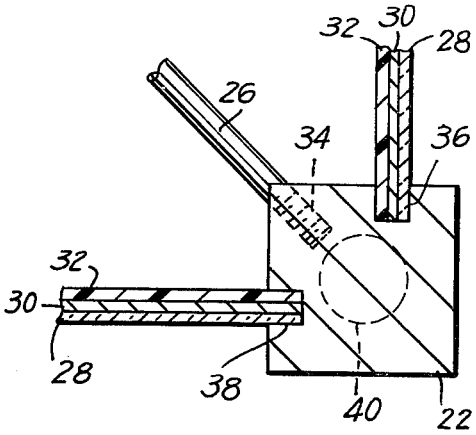
FIG. 2 is a frgmentary sectional view taken along line 202 of FIG. 1.

FIG. 2 better illustrates the demountable securing of each panel assembly consisting of outer panel 28, center panel 30 and inner panel 32 in its respective panel assembly groove 36 and 38. Grooves 36 and 38 are shown as part of fourth corner post 22. Shown, also, is threaded diagonal hole 34 assembled with support frame 26.

Figure 3:
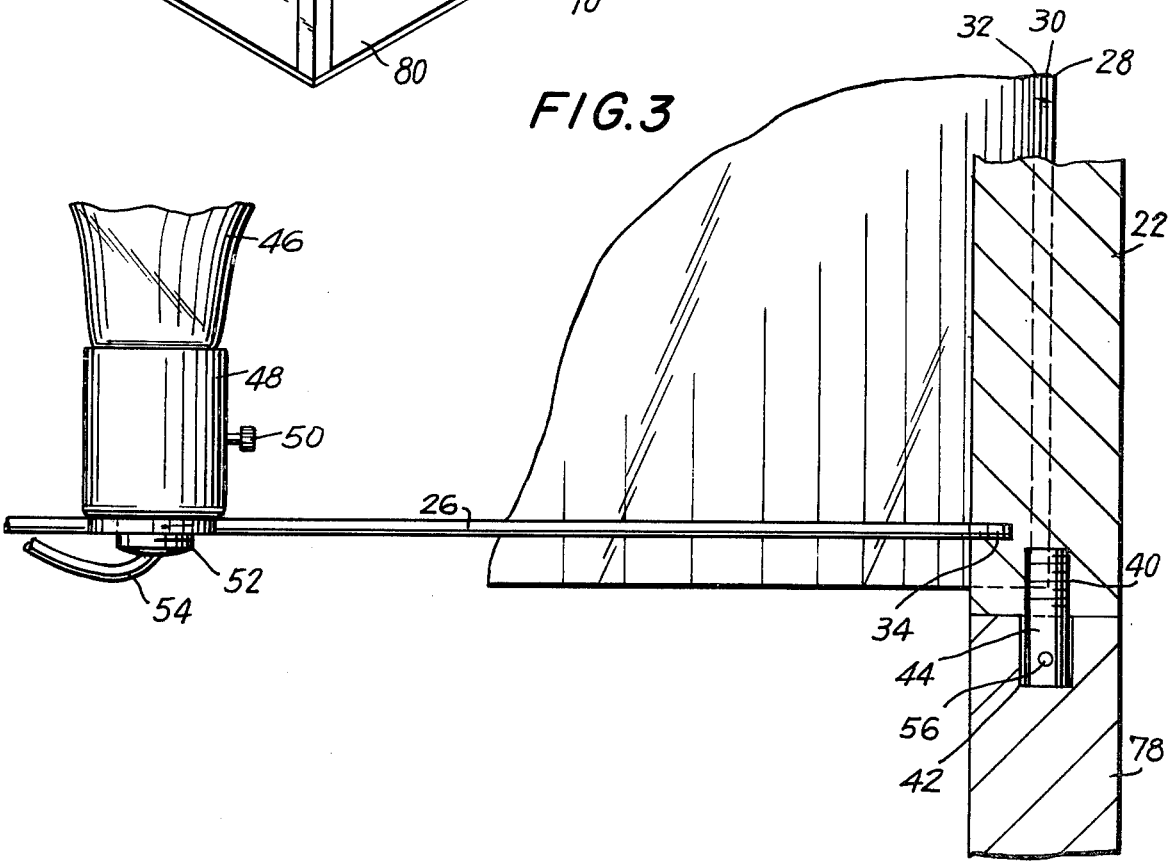
FIG. 3 is a fragmentary sectional view taken along line 3—3 of FIG. 1.

FIG. 3 more clearly illustrates support frame 26 having socket 48 made integral therewith by a locknut 52.

Clearly shown is the means whereby fourth corner post 22 is made integral with fourth support post 78. Fourth corner post 22 has at its bottom end threaded hole 40 and therefore accepts the threaded portion of a connecing stud 44. The smooth portion of connecting stud 44 is inserted in smooth hole 42 located in the topmost end of fourth support post 78.

FIG. 4 better illustrates the purpose and application of connecting stud 44 in making integral fourth corner post 22 and fourth support post 78 and is typical for the use of connecting stud 44.

As has been described hereinbefore, as assembly of outer panel 28, center panel 30 and inner panel 32 is made ready for securing in second panel assembly groove 38, as is another assembly of outer panel 28, center panel 30 and inner panel 32 also made ready for securing in first panel assembly groove 36.

Described hereinbefore is the assembly of the threaded portion of support frame 26 with threaded diagonal hole 34.

To recapitulate, the bottommost end of fourth corner post 22 has threaded hole 40 which accepts the threaded portion of connecting stud 44. The smooth portion of connecting stud 44 has proximate its bottommost end a crosswise hole 56. The smooth portion of connecting stud 44 is made to engage smooth hole 42 found in the topmost end of fourth support post 78. Proximate the topmost end of support post 78 is matching hole 58 connecting a face thereof with smooth hole 42.

Connecting stud 44 is adjusted in such a manner as to permit the insertion of a locking pin 60 in matching hole 58 and crosswise hole 56 in order to make corner post 22 integral with support post 78. In a similar manner, corner posts 16, 18 and 20 are made integral with respective support posts 72, 74 and 76.

FIG. 5 shows a lighting subassembly module supported from overhead hook and generally designated 12.

The corner posts 16, 18, 20 and 22 are made integral with the various panel assemblies 82, 84, 86 and 88. The foregoing items are secured by means of support frame 26 and separator frame 24.

It may be seen that the subassembly 12 is inverted when compared to the subassembly 10. The center panel 30 of the panel assemblies shown, with what may be photographs, are assembled so as to result in the photographs being upright.

Bulb 46 is assembled with socket 48 which is secured to support frame 26 with locknut 52. Electrical line cord 54 connects socket 48 to the nearest electrical outlet (not shown).

Assembly 12 is supported from an overhead support hook 68, which may be secured to a ceiling or the like, by means of a support cord 70.

Connecting stud 44 is inserted in each threaded hole 40 of each corner support 16, 18, 20 and 22. Each end of each support cord 70 passes through a respective crosswise hole 56 and is fastened to itself, the midpoints of each support cord 70 resting on support hook 68.

FIG. 6 illustrates a lighting subasembly module supported on lamp base 14. The lighting subassembly module is assembled in a manner similar to that described for subassembly 14 with an exception. Socket 48, bulb 46 and electric line cord 54 are not secured to support frame 26 but are herein secured to a lamp base 66. In addition, lamp base 66 has a lamp frame 64 adjacent socket 48.

The lighting subassembly module is then supported on lamp frame 64 and support frame 26 is secured thereto with a shade nut 62.

Socket 48 may have switch 50 integral although this is not a requirement of my invention. Electric line cord 54 connects socket 48 to an electrical outlet (not shown).

It can be readily perceived that the lighting subassembly module is capable of assembly with a variety of mounting arrangements. Not illustrated but contemplated is the assembly of lighting subassembly module with other modules of similar size and shape, each module may contain its own source of illumination, or not, as is desired.

Although the illumination herein shown is an incandescent bulb, this does not preclude the use of fluorescent bulbs or other forms of illumination to illuminate the panels.

It is also contemplated that outer panel 28 may be a lenticular lens whereby the use of a complementary center panel 30 will result in a three-dimensional effect.

Further, it can be seen that the modular lighting system described may be easily modified and altered by the person desiring to use the system.

The embodiments of the invention particularly disclosed and described hereinabove are presented merely as an examples of the invention. Other embodiments, forms and modifications of the invention coming within the proper scope and spirit of the appended claims will, of course, readily suggest themselves to those skilled in the art.

What is claimed is:

1. A modular lighting system, comprising, in combination: an assembly including holding means for holding translucent indicia at a predetermined disposition, a light source disposed behind the indicia with respect to a viewer, means facilitating enterchangeability and replacement of said indicia with other indicia, and support means facilitating supporting said assembly at one or more of a number of locations with respect to supporting surfaces, said holding means and said interchangeability facilitating means comprising at least one first set of upstanding columns each of which being formed with recesses in face portions thereof, frame means interconnecting and structurally aligning said columns with respect to one another and with respect to said support means, said support means comprising a second set of upstanding columns extending when assembled with said holding means in substantial alignment with said first set of columns, pairs of opposing recesses formed within pairs of said first set of columns accommodating said indicia.

2. A modular lighting system according to claim 1, wherein said assembly inlcudes a separator frame having four corners substantially perpendicular to said frame and integral with each corner area; four corner posts, each said post having two lengthwise grooves for demountably securing between each two adjacent said corner posts a panel assembly for displaying a design contained therein, said light source providing means for illumination of said panel assemblies.

3. The device of claim 2, wherein said panel assembly consists of an outer panel, an inner panel and a center panel containing the design.

4. The device of claim 2, wherein said panel assembly consists of a center panel comprising a photograph.

5. The device of claim 2, wherein said panel assembly consists of an outer panel comprising a lenticular lens and a center panel comprising indicia suitable for viewing as a three-dimensional indicia when combined with the aforesaid outer panel.

6. The device of claim 2, wherein said means for illumination consists of an incandescent bulb.

7. The device of claim 2, wherein said means for illumination consists of a fluorescent bulb.

8. The device of claim 2, wherein said support means comprises four connecting studs combined with four support posts.

9. The device of claim 2, wherein said support means comprises four connecting studs combined with two support cords.

10. The device of claim 2, wherein said support means comprises a lamp base and a lamp frame.

* * * * *